US008757456B2

(12) United States Patent
Bevier et al.

(10) Patent No.: US 8,757,456 B2
(45) Date of Patent: Jun. 24, 2014

(54) DOUBLE-WIDE STRAP

(75) Inventors: Joseph J. Bevier, Portland, OR (US); Tory M. Cross, Portland, OR (US); Cera Elizabeth Crockett, Portland, OR (US)

(73) Assignee: Nike, Inc., Beaverton, OR (US)

( * ) Notice: Subject to any disclaimer, the term of this patent is extended or adjusted under 35 U.S.C. 154(b) by 225 days.

(21) Appl. No.: 12/984,922

(22) Filed: Jan. 5, 2011

(65) Prior Publication Data

US 2012/0168474 A1 Jul. 5, 2012

(51) Int. Cl.
*A45F 3/14* (2006.01)

(52) U.S. Cl.
USPC ..... 224/264; 224/607

(58) Field of Classification Search
USPC ..... 224/264, 627, 607, 610, 616, 643; 42/264, 627
See application file for complete search history.

(56) References Cited

U.S. PATENT DOCUMENTS

| | | | | |
|---|---|---|---|---|
| 4,337,938 | A * | 7/1982 | Rodriguez | 482/74 |
| 4,389,005 | A * | 6/1983 | Cable et al. | 224/159 |
| 5,544,795 | A * | 8/1996 | Perrin | 224/254 |
| 2005/0205620 | A1 * | 9/2005 | Yagisawa | 224/159 |

* cited by examiner

*Primary Examiner* — Adam Waggenspack
(74) *Attorney, Agent, or Firm* — Shook, Hardy & Bacon L.L.P.

(57) ABSTRACT

Embodiments of the present invention relate to a cupped shoulder strap. In general, the cupped shoulder strap may be comprised of a cupped shoulder strap receiving section and a plurality of strap. The cupped shoulder receiving section may have a lateral portion and a medial portion. To form a cupped shape, the lateral portion may be affixed, in a nonparallel orientation, to the medial portion at a superior affixing point that is proximate superior ends of the lateral and medial portions. Further, the lateral portion may be affixed, in a nonparallel orientation, to the medial portion at an inferior affixing point that is proximate inferior ends of the medial and lateral portions.

18 Claims, 5 Drawing Sheets

DOUBLE-WIDE STRAP

BACKGROUND

Straps are used in a variety of application to support an object, such as a bag from various portions of a user. For example, a duffel bag, computer bag, or other bag typically containing a strap that is intended to rest on a shoulder of a user allows the user to carry the bag with reduced use of a hand. A typical strap extends from one point on the bag to another point on the bag, which allows the shoulder to receive some portion of the strap that extends between the points. Therefore, in this typical strap, no one area of the strap may be adapted specifically for contacting the user. Further, some straps may contain a pad that slides along a portion of the strap for the user to place between his/her shoulder and the strap. Other straps may incorporate padding into a portion of the strap to achieve a similar effect as the sliding pad. However, a typical strap, regardless of padding or not, may have a tendency to slip off of the user's shoulder as the strap is being relied upon to support an object. Additionally, a typical strap may not form to the contours of the user to provide support and stability when in an as-worn position.

SUMMARY

Embodiments of the present invention relate to a cupped shoulder strap. In general the cupped shoulder strap may be comprised of a cupped shoulder strap receiving section and a plurality of strap. The cupped shoulder receiving section may have a lateral portion, which is defined with a first medial edge, an opposite first lateral edge, a first superior end and an opposite first inferior end. The cupped shoulder receiving section may also have a medial portion. The medial portion may have a second medial edge, an opposite second lateral edge, a second superior end, and an opposite second inferior end. Additionally, the lateral portion is affixed, in a nonparallel orientation, to the medial portion at a superior affixing point that is proximate the first superior end and the second superior end. Further, the lateral portion is affixed, in a nonparallel orientation to the medial portion at an inferior affixing point that is proximate the first inferior end and the second inferior end.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
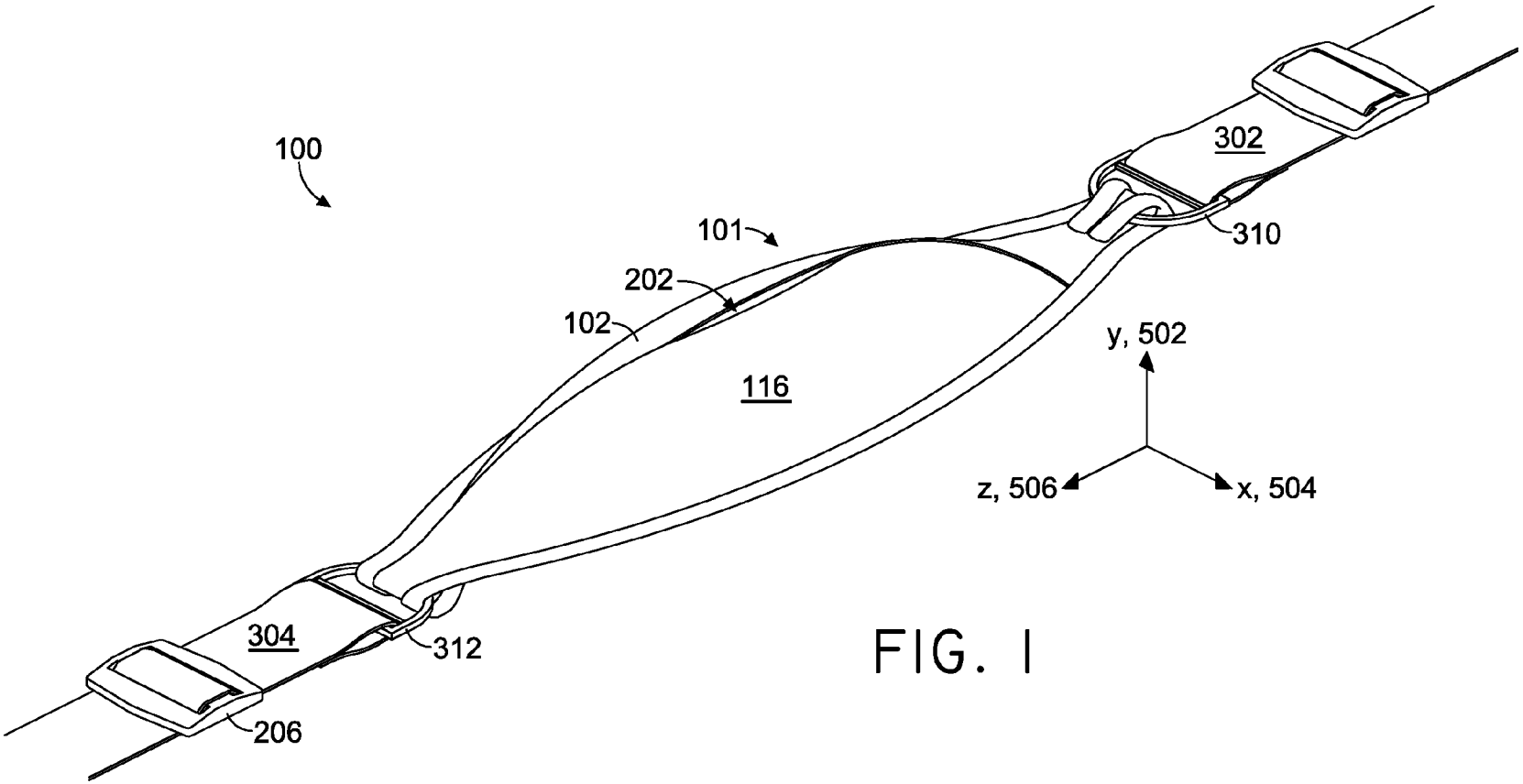
FIG. 1 depicts a perspective view of an exemplary cupped shoulder strap in accordance with aspects of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to a cupped shoulder strap. In general the cupped shoulder strap may be comprised of a cupped shoulder strap receiving section and a plurality of strap. The supped shoulder receiving section may have a lateral portion. The lateral portion may be defined with a first medial edge and an opposite first lateral edge. The lateral portion also may have a first superior end and an opposite first inferior end. The first medial edge, between the first superior end and the first inferior end, has a first length. The cupped shoulder receiving section may also have a medial portion. The medial portion may have a second medial edge and an opposite second lateral edge. The medial portion may also have a second superior end and an opposite second inferior end. The second medial edge, between the second superior end and the second inferior end, has a second length. Additionally, the lateral portion is affixed, in a nonparallel orientation, to the medial portion at a superior affixing point that is proximate the first superior end and the second superior end. Further, the lateral portion is affixed, in a nonparallel orientation to the medial portion at an inferior affixing point that is proximate the first inferior end and the second inferior end.

Accordingly, in an aspect, the present invention provides a cupped shoulder strap having a cupped shoulder receiving section. The cupped shoulder receiving section includes a top surface and an opposite bottom surface as well as a first end and an opposite second end. Further, the cupped shoulder receiving section has a first portion extending from a superior affixing location to an inferior affixing location. The first portion has a first medial edge and an opposite first lateral edge. The cupped shoulder receiving portion may include a second portion extending from the superior affixing location to the inferior affixing location, the second portion having a second medial edge and an opposite second lateral edge. Further, the first portion and the second portion form a convex shape of the top surface extending from the first lateral edge to the second lateral edge, the first portion and the second portion form a convex shape of the bottom surface extending from the first lateral edge to the second lateral edge. The cupped shoulder strap also has a first strap extending from the first end of the cupped shoulder receiving section, wherein a length of the first strap is adjustable. Additionally, the cupped shoulder strap also includes a second strap extending from the second end of the cupped shoulder receiving section.

In another aspect, the present invention provides a cupped shoulder strap. The cupped shoulder strap includes a first portion of a cupped region. The first portion is a flexible material having a first top surface, an opposite first bottom surface, a first lateral edge, an opposite first medial edge, a first distal end, and an opposite first proximal end. The cupped shoulder strap also includes a second portion of a cupped region, wherein the second portion is a flexible material having a second top surface, an opposite second bottom surface, a second lateral edge, an opposite second medial edge, a second distal end, and an opposite second proximal end. The first portion and the second portion are affixed, at a proximal affixing location, to one another proximate the first proximal end and the second proximal end. The first medial edge and the second medial edge are skewed in orientation resulting in a nonparallel relationship between the first medial edge and the second medial edge as each of the first portion and the second portion extend from the proximal affixing location. The first portion and the second portion are affixed, at a distal affixing location, to one another proximate the first distal end and the second distal end. The first medial edge and the second medial edge are skewed in orientation resulting in a nonparallel relationship between the first medial edge and the second medial edge as each of the first portion and the second portion extend from the distal affixing location toward the proximal affixing location. The cupped shoulder strap may also include a first strap portion extending from a first coupling location. The first coupling location is proximate the first proximal end. The cupped shoulder strap also includes a second strap portion extending from a second coupling location. The second coupling location is proximate the first distal end.

Having briefly described an overview of embodiments of the present invention, a more detailed description follows.

Figure 5:
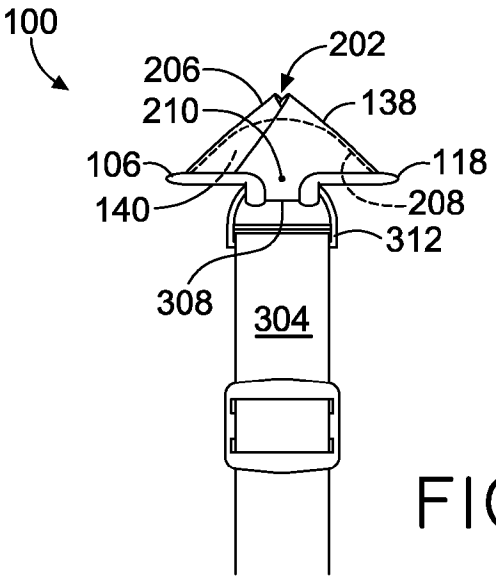
FIG. 5 depicts a front profile view of an exemplary cupped shoulder strap in accordance with embodiments of the present invention.
Figure 6:
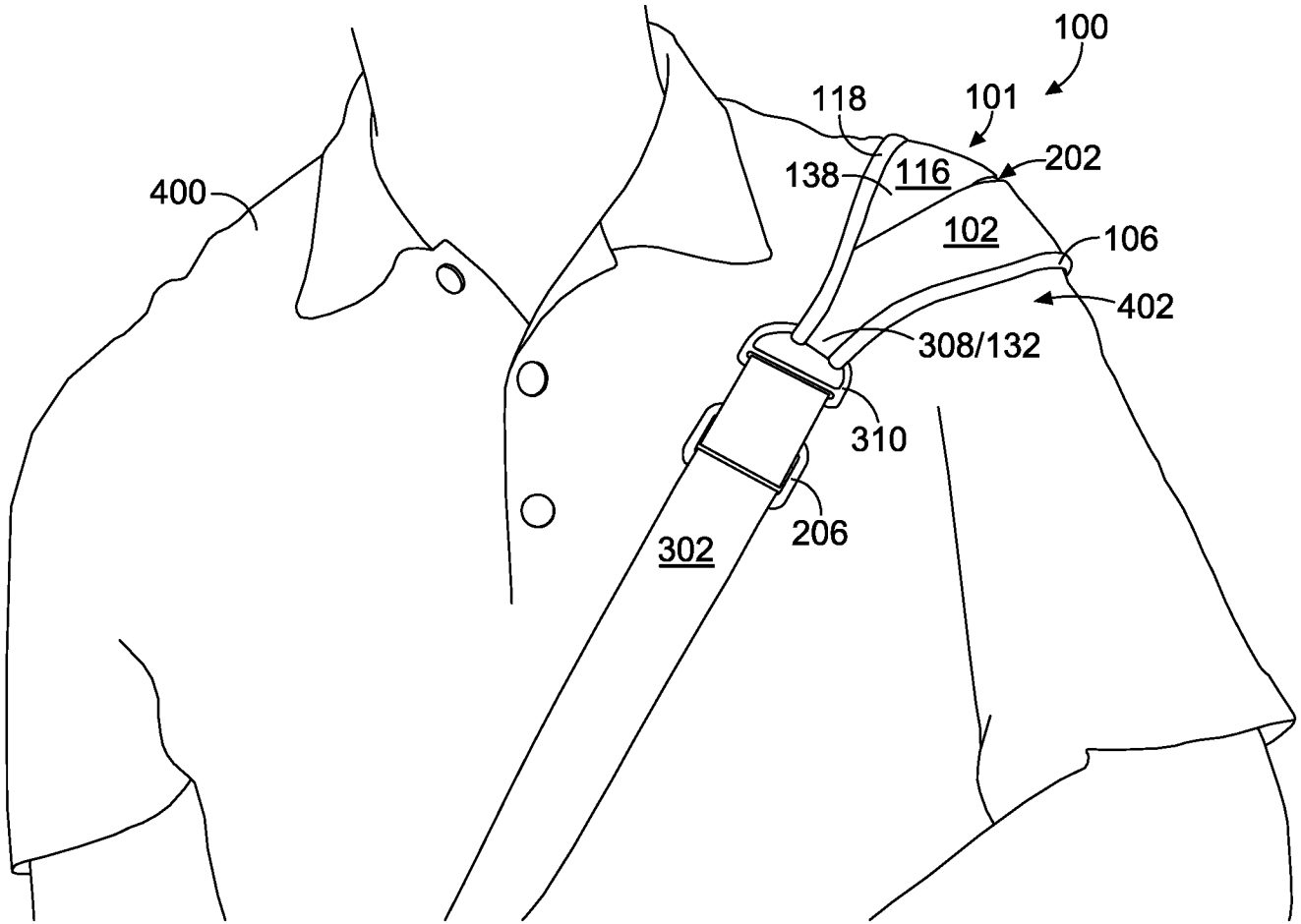
FIG. 6 depicts an exemplary cupped shoulder strap in an exemplary as-worn position on a user in accordance with embodiments of the present invention.

In aspects, a cupped shoulder strap 100 is comprised of a cupped shoulder receiving section 101, a first strap 302, and a second strap 304. The cupped shoulder receiving section 101, in aspects forms a convex shape 208 (as best seen in FIG. 5) that forms to a shoulder 402 of a wearer/user 400 (as best seen in FIG. 6). Consequently, the cupped shoulder strap 100 is able to conform to the shoulder 402, which may inhibit movement of the cupped shoulder strap 100 in one or both of an X axis 504 (left to right) and/or a Z axis 506 (front to back). Additionally, the cupped shoulder strap 100 may provide additional support for maintaining an attached object (e.g., bag) in a desired orientation relative to the wearer 400. For example, if the cupped shoulder strap 100 is used in connection with a messenger-type bag that crosses a torso of the wearer 400, the cupped shoulder strap 100 may help maintain the messenger-style bag in a position across the body of the wearer. Other exemplary advantages (e.g., ventilation, distribution of force) of the cupped shoulder strap 100 will be discussed hereinafter.

While aspects of the present invention are discussed with respect to a "shoulder" herein, it is contemplated that the various aspects discussed are equally adapted for use at other anatomical regions, orientation, and/or positions. Therefore, the use of the term "shoulder" is not limiting as to the scope of the present invention, but instead used herein to help facilitate understanding of the various aspects discussed and insinuated herein.

The cupped shoulder receiving section 101 is comprised of a lateral portion 102, a medial portion 116, a first ring 310, and a second ring 312. The lateral portion 102 and the medial portion 116 may be constructed of a polymer-based material, such as a polyester or nylon. It is also contemplated that other flexible materials may be utilized (e.g., cotton-based material or other natural fiber material). Further, it is contemplated that a combination of materials may be utilized to provide both tensile force resistance and energy absorbing characteristics. For example, a foam material may be incorporated with (e.g., layered) the flexible materials to form a shoulder strap having resistance to a force applied by an attached object (e.g., bag) while still spreading the load across a greater area utilizing an energy absorbing layer. Additionally, it is contemplated that a non-slip material, coating, or other layer may be utilized on or more surfaces of the cupped shoulder strap 100 to further assist in maintaining a desired position on a user's shoulder.

The lateral portion 102 may be defined by a medial edge 104 and an opposite lateral edge 106. Further, the lateral portion 102 has opposite ends, a superior end 108 and an inferior end 110. Consequently, a lateral length 114 of the lateral edge 106 may be defined as extending from the superior end 108 to the inferior end 110 along the lateral edge 106. Similarly, a medial length 112 of the medial edge 104 may be defined as extending from the superior end 108 to the inferior end 110 along the medial edge 104. As stated herein, the medial length 112 and the lateral length 114 may represent a measurement of a lengthwise perimeter of the lateral portion 102. This is in contrast to a linear length that is not tied to a path taken by the lateral portion 102. Instead, a linear length is a linear measurement between two points.

The medial portion 116 may be defined by a medial edge 120 and an opposite lateral edge 118. Further, the medial portion 116 has opposite ends, a superior end 122 and an inferior end 124. Consequently, a lateral length 128 of the lateral edge 118 may be defined as extending from the superior end 122 to the inferior end 124 along the lateral edge 118. Similarly, a medial length 126 of the medial edge 120 may be defined as extending from the superior end 122 to the inferior end 124 along the medial edge 120. As indicate earlier with respect to the medial length 112 and the lateral length 114, the medial length 126 and the lateral length 128 are also a lengthwise perimeter measurement as opposed to a linear measurement.

To expand even further on the distinction between a linear measurement and a perimeter-type measurement, when an edge is linear, a perimeter measurement and a linear measurement may be comparable. However, if an edge includes a bend or other deviation from straight, a perimeter measurement may be greater than a linear measurement.

In an exemplary aspect, the lateral portion and the medial portion are positioned relative to one another to form a cupped structure that is able to receive the shoulder 402. A cupped structure, in an exemplary aspect, has a curvature in all three orthogonal planes. For example, FIG. 1 depicts the cupped shoulder receiving section 101 as well as the three orthogonal planes defined by the X axis 504, the Z axis 506, and a Y axis 502. The cupped shoulder receiving section 101, in this exemplary aspect, includes a curvature in a first plane defined by the Y axis 502 and the Z axis 506 (e.g., curving from the superior end 108 to the inferior end 110, which is referred to as a length-wise curve. The cupped shoulder receiving section 101 also curves, in this exemplary aspect, in a second plane defined by the X axis 504 and the Y axis 502 to form the convex shape 208 illustrated in FIG. 5, which is referred to as a width-wise curve. Additionally, the cupped shoulder receiving section 101 also curves, in this exemplary aspect, in third plane defined by the X axis 504 and the Z axis 506, which is referred to as an outward curve. Consequently, the cupped shoulder receiving section 101 may include a length-wise curve, a width-wise curve, and/or an outward curve. When one or more of the discussed curves are formed by a non-parallel orientation of one or more members (medial portion, lateral portion), a cupped form may be created. The cupped form is a shaped portion of a strap that maintains one or more curved even when not in an as-worn position (at rest).

Figure 2:
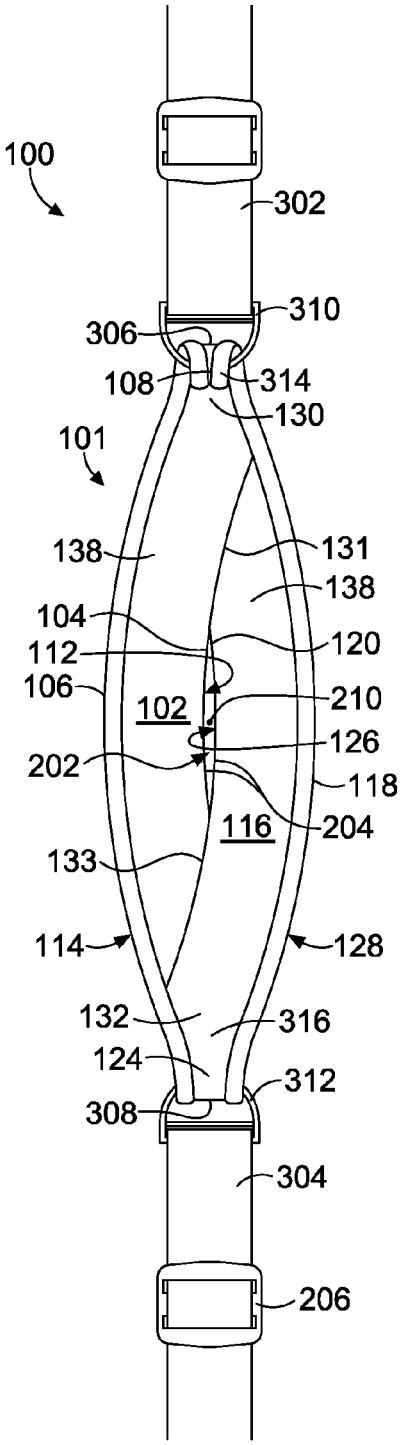
FIG. 2 depicts a top surface view of an exemplary cupped shoulder strap in accordance with aspects of the present invention.

A curved shape may be accomplished by manipulating an orientation of one or more members when coupled to another member. For example, FIG. 2 depicts an upper surface view of the cupped shoulder strap 100 in accordance with embodiments of the present invention. An outward curve is demonstrated by both the lateral portion 102 and the medial portion 116.

To achieve the outward curves of both the lateral edge 106 and the lateral edge 118 illustrated in FIG. 2, the lateral portion 102 may be coupled to the medial portion 116 at a superior affixing location 130 and at an inferior affixing location 132 in a non-parallel manner. It is contemplated that a bottom surface 140 of the lateral portion 102 is affixed to a top surface 138 of the medial portion 116 proximate the superior ends 108 and 122. The point at which proximate superior ends 108 and 122 are affixed is referred to herein as a superior affixing location 130. Similarly, an inferior affixing location 132 describes a location proximate the inferior ends 110 and 124 at which the lateral portion 102 is affixed to the medial portion 116. In an exemplary aspect, the bottom surface 140 of the medial portion 116 is affixed to the top surface 138 of the lateral portion 102 at the inferior affixing location 132. It is contemplated that different combinations of top surfaces and bottom surfaces may be in contact with each other at either the superior affixing location 130 and/or the inferior affixing location 132.

Further, it is contemplated that depending on an orientation of coupling, a shape of the various portions and other factors may change the location and relationship of the superior affixing location 130 and the inferior affixing location 132. For example, as depicted in FIG. 2, the medial portion 116 overlaps an extended length of the lateral portion 102 proximate the inferior ends 110 and 124. The portion of overlap may constitute the entirety of the inferior affixing location 132, such as when the medial portion 116 and the lateral portion 102 are coupled together utilizing a stitching technique in the area of overlap. In an alternative, if a limited area of the overlap is utilized to couple the medial portion 116 to the lateral portion 102, such as with a rivet or other mechanical coupler, then that portion utilized to couple the portions may constitute the inferior affixing location.

It is contemplated that the medial portion 116 and the lateral portion 102 may be affixed/coupled to one another utilizing any number of techniques. For example, as already indicated, stitching, sewing, riveting, and other similar known methods may be implemented. Additional examples may include adhesives, welding techniques, or other chemical processes. Further, it is contemplated that the lateral portion 102 and the medial portion 116 are constructed from a common material that may turn back onto itself proximate an affixing location (or other location such as a coupling location) to form the other portion. Therefore, while the terms coupling and affixing are utilized herein when discussing a union of the medial portion 116 and the lateral portion 102, it is understood that the mere continuation of a unitary piece at a coupling or affixing location is contemplated as being within the scope of exemplary aspects of the present invention.

With continued reference to FIG. 2, proximate the superior affixing location 130, the cupped shoulder receiving section 101 folds over onto itself after passing through a first ring 310. The portion that folds back on to itself is referred to herein as the superior double back portion 314, which forms a superior coupling location 306. The first ring 310 represents a coupling member. In particular, the first ring 310 is illustrated as a 'D' ring-type member. However, it is contemplated that any coupling member may be substituted for the D ring in exemplary embodiments. For example, it is contemplated that a portion of the strap 302 itself may serve as the first ring 310. A similar arrangement is illustrated proximate the inferior ends 110 and 124 resulting in an inferior double back portion 316 and an inferior coupling location 308.

The superior coupling location 306 provides a location of the cupped shoulder receiving section 101 to couple with the strap 302 by way of the first ring 310. Likewise, the inferior coupling location provides a location of the cupped shoulder receiving section 101 to couple with the strap 304 by way of a second ring 312.

Figure 3:
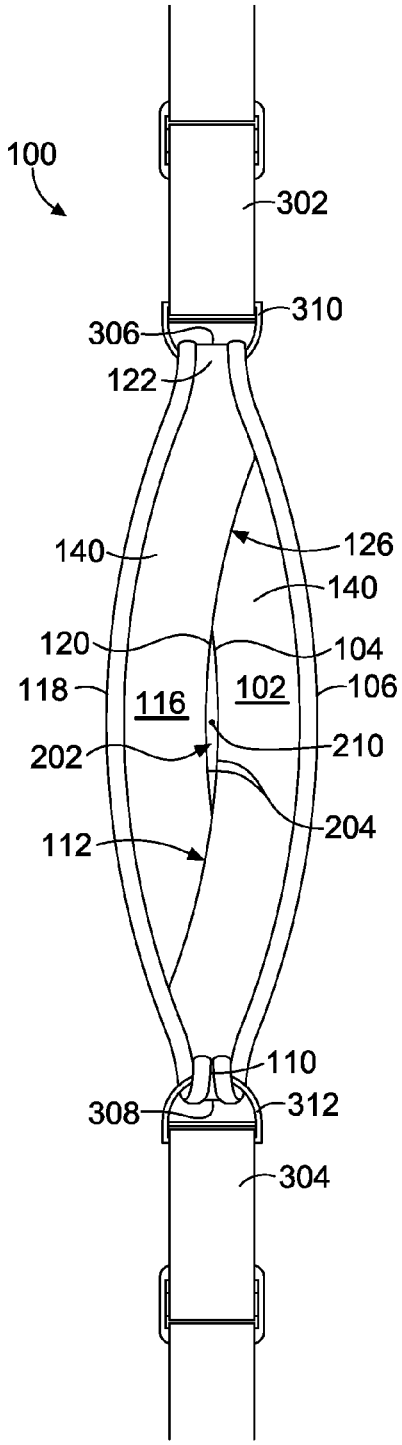
FIG. 3 depicts a bottom surface view of an exemplary cupped shoulder strap in accordance with aspects of the present invention.

FIG. 2 illustrates the superior double back portion 314 doubling back towards the top surface 138. Conversely, FIG. 3 illustrates the inferior coupling location 308 doubling back towards the bottom surface 140. It is contemplated that any combination of directions to which the double back portions may extend.

A void perimeter 204 defines a void 202 located between the medial portion 116 and the lateral portion 102, as depicted in FIG. 2. The void perimeter 204, in an exemplary aspect, is defined, at least in part, by the medial edge 120 along a length of the medial portion 116 that is not overlapping a portion of the lateral portion 102. Similarly, the void perimeter may further be defined, in an exemplary embodiment, by the medial edge 104 along a length of the lateral portion 102 that is not overlapping a portion of the medial portion 116. As a result of the void perimeter 204, the resulting void 202 may provide a location to allow circulation of air from the bottom surface 140 towards the top surface 138. Additionally, the void 202 may provide adaptability to allow the cupped shoulder receiving section 101 to conform to an anatomical structure of a user. Additionally, the void 202 may allow for the cupped shoulder strap 100 to be utilized in a variety of as-worn orientations and positions by providing flexibility and adaptability to the resulting shape of the cupped shoulder receiving section 101.

Figure 4:
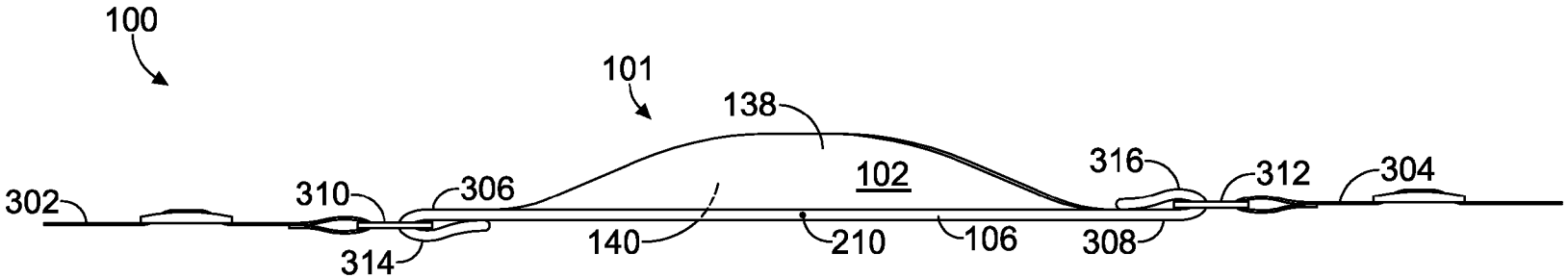
FIG. 4 depicts a side profile view of an exemplary cupped shoulder strap in accordance with aspects of the present invention.

FIG. 4 depicts a side profile view of the cupped shoulder strap 100 in accordance with embodiments of the present invention. The side profile demonstrates that it is contemplated that the superior double back portion 314 may double back towards the bottom surface 140 and that the inferior double back portion 316 may double back towards the top surface 138. However, as previously discussed, it is contemplated that a double back portion may double back toward either surface or a double back portion may also be created by a unitary piece of material doubling back to form another portion (e.g., the medial portion 116, the lateral portion 102) of the cupped shoulder receiving section 101.

FIG. 4 also illustrates, in this exemplary aspect, a general convex curve extending from the superior coupling location 306 towards the inferior coupling location 308. The general convex curve extends in a direction from the bottom surface 140 toward the top surface 138. Another profile view of the cupped shoulder strap 100 is depicted in accordance with embodiments of the present invention at FIG. 5. Consequently, FIG. 5 depicts the convex shape 208 as generally curving from the lateral edge 106 toward the lateral edge 118.

In exemplary aspects, a general convex curve is provided even when the cupped shoulder strap 100 is in an at-rest condition. This is compared to when tension is applied to either the first strap 302 and/or the second strap 304. When tension is applied to either strap and the straps themselves (or an associated pad) are flexible in nature, the material may "curve" as a result of the tension being applied to the material as it rests on an object. For example, a traditional strap made from flexible webbing is flat when in an at-rest condition, but once a load is applied to the strap and the strap is placed over the shoulder of a user, the traditional strap may take on a curved shape as it conforms to the underlying shoulder. However, the curved shape forced upon the traditional strap is distinctly different from the various convex curves discussed herein with respect to the cupped shoulder strap 100. For example, in an exemplary aspect, the cupped shoulder receiving section 101 maintains a curved shape in one or more planes even when a load is not applied to one or more portions of the cupped shoulder strap 100.

As previously discussed, a length-wise curve, a width-wise curve, and/or an outward curve may be accomplished in exemplary aspects of the cupped shoulder strap through orienting the medial portion 116 in a non-parallel orientation relative to the lateral portion 102. For example, if the medial portion 116 is coupled to the lateral portion 102 at both the superior affixing location 130 and the inferior affixing location 132 such that the medial portion 116 diverges laterally (e.g. in an X-Z plane of FIG. 1) from the lateral portion 102 at each of the affixing location, the medial portion 116 and the lateral portion 102 may bow in one or more directions to form one or more of the curves discussed herein.

For discussion purposes, a midpoint 210 is depicted in FIGS. 2-5. The midpoint 210, in the illustrated aspects, is a midpoint along a linear line extending from the superior coupling location 306 to the inferior coupling location 308. For example, if a line (referred to as a meridian line herein) were to be illustrated as extending from the superior coupling location 306 to the inferior coupling location 308, the midpoint 210 may be located equidistant from both end points (as best seen in FIGS. 2-4). Additionally, the midpoint 210 may also be equidistant from the lateral edge 106 and the lateral edge 118 along a line extending between the two lateral edges (as best seen in FIG. 5). Therefore, the midpoint 210 may provide clarity to discussions surrounding one or more curves (e.g., a length wise curve, a width-wise curve, an outward curve).

For example, as best illustrated in FIG. 2, both the medial portion 116 and the lateral portion 102 are not generally parallel to the meridian line, which includes the midpoint 210. Instead, both the medial portion 116 and the lateral portion 102 are skewed from the meridian line at both the superior affixing location 130 and the inferior affixing location 132. This skewed (or nonparallel) orientation results in the lateral edge 106 and the lateral edge 118 having a length greater than the meridian line as measured from the same end points (e.g., the superior affixing location 130 to the inferior affixing location 132, the superior coupling location 306 to the inferior coupling location 308). Further, it is contemplated that while the lateral edge 106 and the lateral edge 118 may have lengths greater than the meridian line, aspects contemplate the lateral edge 106 and the lateral edge 118 having a similar length to one another (while still being greater than the meridian line). This additional length forms the length-wise curve discussed earlier. A length-wise curve may allow the cupped shoulder receiving section 101 to conform to a user's shoulder in a posterior (dorsal) to anterior (ventral) direction.

Additionally, in an exemplary embodiment, a length as measured along the top surface 138 or the bottom surface 140 extending from the lateral edge 106 to the lateral edge 118 is greater than a linear length (extending through the midpoint 210) between the same lateral edges. This additional length forms the width-wise curve discussed earlier. A width-wise curve may allow the cupped shoulder receiving section 101 to conform to a user's shoulder in a medial to lateral direction.

Exemplary aspects include the first strap 302 and the second strap 304. In an exemplary aspect, both the first strap 302 and the second strap 304 are adjustable in length. Consequently, a user may adjust where the cupped shoulder receiving section 101 contacts the user by adjusting the first strap 302 and/or the second strap 304. For example, when an object, such as a bag, is coupled to the straps (at ends opposite from the superior coupling location 306 and the inferior coupling location 308), gravity may pull the bag so that it hangs perpendicular to the ground However, being able to adjust a length of either the first strap 302 and/or the second strap 304 alters where the cupped shoulder receiving section 101 rests on the user, which may be used to "force" the attached object to rest on the user at a different orientation than provided by a typical strap. For example, a bag may rest across the back of a user as opposed to falling to a side of the user because the cupped shoulder receiving section 101 interacts with the user's shoulder to resist the effects of gravity pulling the bag to the side.

As illustrated in FIG. 2, an adjuster 206 may be incorporated with a strap, such as the first strap 302 or the second strap 304. The adjuster 206 may be effective maintaining an adjusted length of a strap. For example, as a length of a strap is set/adjusted, the adjuster 206 may be effective for maintaining the set length during use.

Consequently, an interaction among the first strap 302, an adjuster, and the first ring 310, in an aspect, provides an effective mechanism for adjusting and maintaining a length of the first strap 302. Similarly, the combination of the second strap 304, the adjuster 206, and the second ring 312, in an aspect, provides an effective mechanism for adjusting and maintaining a length of the second strap 304. It is contemplated that other techniques may be implemented for adjusting and maintaining a length of a strap. For example, hook and loop materials, mechanical fasteners, stitching, and the like may be implemented. Further, it is contemplated that one or more straps may not be adjustable in length.

FIG. 6 illustrates an exemplary cupped shoulder strap 100 in an as-worn orientation in accordance with aspects of the present invention. As illustrated, the cupped shoulder receiving section 101 forms to the outside (both an upper portion and a lateral portion) of the shoulder 402. The cupped shoulder receiving section 101 may further be adapted, as illustrated, to form to the shoulder 402 by allowing the lateral portion 102 to rest on a lateral portion of the shoulder 402 and the medial portion resting on an upper portion of the shoulder 402. Consequently, the void 202 may adjust in shape to accommodate the shoulder 402 as the lateral portion 102 and the medial portion 116 form to a user's anatomy.

Additionally illustrated, the first ring 310 may be functional for allowing the first strap 302 to pivot about the inferior coupling location 308 so as to minimally disrupt the cupped shoulder receiving section 101 as it form to the shoulder 402. For example, the first ring 310 may include a rounded portion for interacting with either the cupped shoulder receiving section 101 or the first strap 302.

In an exemplary aspect of the present invention, the first strap 302 and the second strap 304 are distinctly separate straps. Stated differently, the cupped shoulder strap 100, in an exemplary aspect, does not include a unitary strap that extends across the cupped shoulder receiving section 101. For example, some traditional bag straps may be a unitary strap extending from one side of the bag to another. The unitary strap in this example may include a pad that is slidable along the length of the unitary strap. However, the unitary strap having a pad fails to achieve the functionality provided by the embodiments discussed herein.

Figure 7:
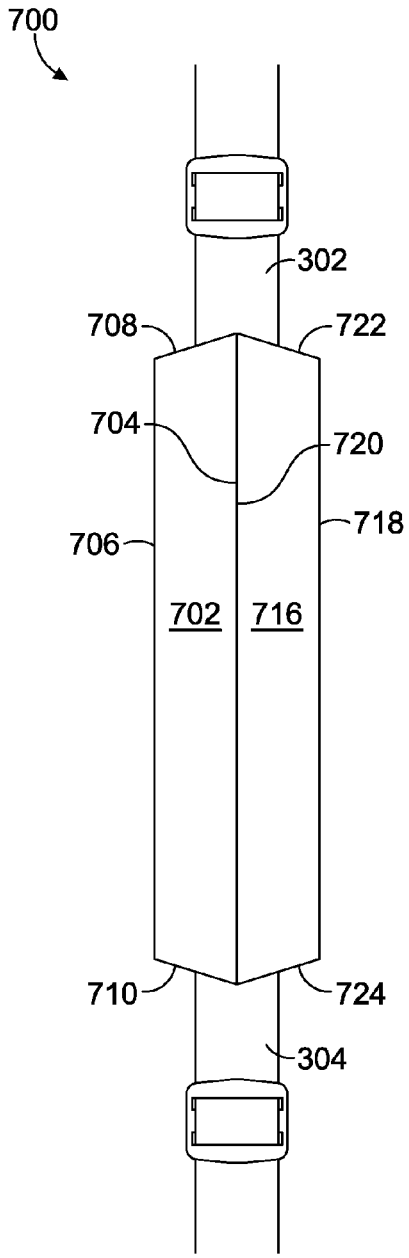
FIG. 7 depicts an exemplary cupped shoulder strap having a medial portion and a lateral portion of a different orientation in accordance with embodiments of the present invention.

FIG. 7 depicts an exemplary cupped shoulder strap 700 in accordance with aspects of the present invention. Features of the cupped shoulder strap 700 are identified by numbering beginning in the seven hundreds (e.g., 7XX) that are similar to those features discussed with respect to FIGS. 1-6. For example, the cupped shoulder strap 700 is comprised of a lateral portion 702 (may be equivalent to the lateral portion 102) and a medial portion 716 (may be equivalent to the medial portion 116). Similarly, the lateral portion 702 includes a medial edge 704, a lateral edge 706, a superior end 708, and an inferior end 710. Each of the edges and ends of the lateral portion 702 may correspond to a similar named feature of the lateral portion 102 (e.g., medial edge 104 may be equivalent to the medial edge 704; the lateral edge 106 may be equivalent to the lateral edge 706). Consequently, not all numbered features of FIG. 7 are discussed herein explicitly, rather a correlation may be drawn to similarly numbered (but with different value in the hundreds location) features discussed herein.

The lateral portion 702 and the medial portion 716, in this exemplary aspect, are parallel in orientation to one another. This is in contrast to the lateral portion 102 and the medial portion 116 as discussed with respect to FIG. 2. However, even in a parallel orientation, it is contemplated that the medial portion 716 and/or the lateral portion 702 may include a curve (e.g., length-wise curve, width-wise curve) as a result of a deformation or other characteristic of either portion. For example, the medial edge 704 and/or the medial edge 720 may have a length, as measured from an inferior end to a superior end, that is greater than a linear length measured from the same locations. This excess length may result in the medial edges bulging to form a curved shape.

Figure 8:
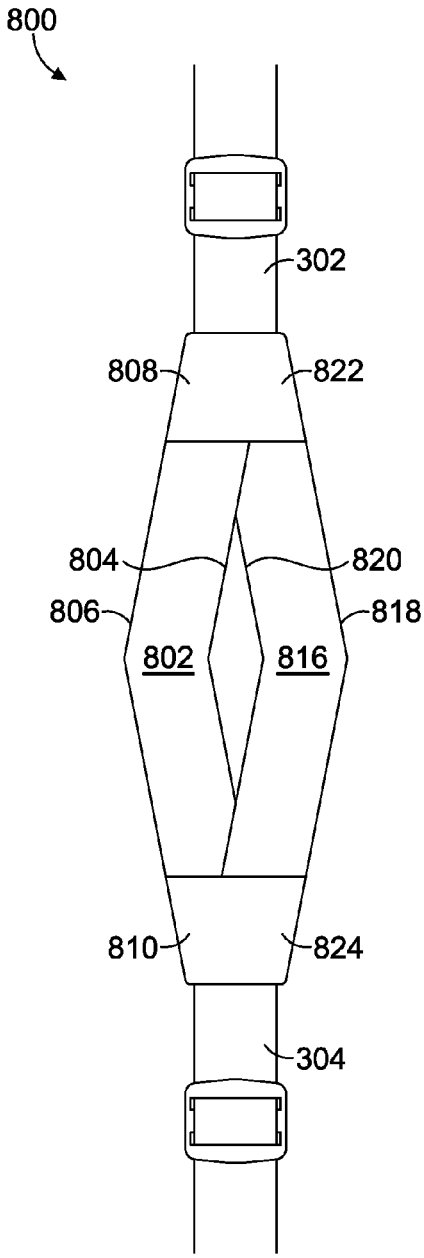
FIG. 8 depicts another exemplary cupped shoulder strap having a medial portion and a lateral portion of another different orientation in accordance with embodiments of the present invention.

FIG. 8 illustrates an exemplary cupped shoulder strap 800 in accordance with aspects of the present invention. As similarly discussed with respect to FIG. 7, consistency of the last two digits of the numbered features represent a correlation to those features discussed with respect to FIGS. 1-6. The cupped shoulder strap 800 is comprised of a medial portion 816 and a lateral portion 802. In this example, the lateral portion 802 and the medial portion 816 may be shaped in a manner that forms a void without creating a length-wise curve extending from a superior end to an inferior end. As depicted in FIG. 8, the lateral portion 802 and the medial portion 816 are affixed to one another in a nonparallel orientation at both the superior end and the inferior end. However, as indicated herein, a length-wise curve (in an at rest position, which is the opposite of an in-worn orientation) may be avoided while still achieving the nonparallel orientation of the lateral portion 802 and the medial portion 816.

The term "proximate" is used herein to describe a physical relationship among various portions, features, objects, or other components. The use of the term proximate indicates a relational position that is approximate to or at an identified location. Consequently, normal manufacturing variations in technique, material, or properties are taken into account, in an exemplary aspect, when utilizing the term proximate.

Although the cupped shoulder strap is described above by referring to particular embodiments, it should be understood that the modifications and variations could be made to the cupped shoulder strap described without departing from the intended scope of protection provided by the following claims.

The invention claimed is:

1. A cupped shoulder strap comprising:

a shoulder cup having a lengthwise curve and a widthwise curve when not in an as-worn position, the shoulder cup comprising:

a lateral portion having a first top surface and a first bottom surface, a first medial edge and an opposite first lateral edge, the lateral portion also having a first superior end and an opposite first inferior end, wherein the first medial edge between the first superior end and the first inferior end has a first length;

a medial portion having a second top surface and a second bottom surface, a second medial edge and an opposite second lateral edge, the medial portion also having a second superior end and an opposite second inferior end, wherein the second medial edge between the second superior end and the second inferior end has a second length, wherein the second length is different from the first length;

a superior affixing point, wherein the lateral portion is affixed, in a nonparallel orientation, to the medial portion at the superior affixing point, which is proximate the first superior end and the second superior end, wherein the first bottom surface of the lateral portion is affixed to the second top surface of the medial portion;

an inferior affixing point, wherein the lateral portion is affixed, in a nonparallel orientation, to the medial portion at the inferior affixing point, which is proximate the first inferior end and the second inferior end, wherein the second bottom surface of the medial portion is affixed to the first top surface of the lateral portion; and a void perimeter defined by the first medial edge and the second medial edge.

2. The cupped shoulder strap of claim 1, a linear length extending from the superior affixing point to the inferior affixing point is less than the first length.

3. The cupped shoulder strap of claim 1, wherein a linear length extending from the superior affixing point to the inferior affixing point is less than the second length.

4. The cupped shoulder strap of claim 1, wherein the void perimeter is located between the superior affixing point and the inferior affixing point.

5. The cupped shoulder strap of claim 1, wherein the cup is a convex structure configured to receive a user's shoulder.

6. The cupped shoulder strap of claim 1 further comprising:

a first adjustable strap coupled at a superior coupling location superior of the superior affixing point; and a second adjustable strap coupled at an inferior coupling location that is inferior to the inferior affixing point.

7. The cupped shoulder strap of claim 6, wherein the first strap is adjustably coupled at the superior coupling location utilizing a first ring and wherein the second strap is adjustably coupled at the inferior coupling location utilizing a second ring.

8. The cupped shoulder strap of claim 6, wherein a length of the first strap and a length of the second strap are adjustable.

9. The cupped shoulder strap of claim 1, wherein the medial portion and the lateral portion are a continuous material that doubles back over at either the inferior coupling location or the superior coupling location.

10. A cupped shoulder strap comprising:

a cupped shoulder receiving section having a top surface and an opposite bottom surface, and a first end and an opposite second end, the cupped shoulder receiving section comprised of:

(1) a first portion extending from a superior affixing location to an inferior affixing location, the first portion having a first top surface and a first bottom surface, a first medial edge having a first medial length and an opposite first lateral edge having a first lateral length, the first medial length being different from the first lateral length, (2) a second portion extending from the superior affixing location to the inferior affixing location, the second portion having a second top surface and a second bottom surface, a second medial edge having a second medial length and an opposite second lateral edge having a second lateral length, the second medial length being different from the second lateral length, (3) a cupped form, wherein the first portion and the second portion form a convex shape of the top surface extending from the first lateral edge to the second lateral edge, and the first portion and the second portion form a convex shape of the bottom surface extending from the first lateral edge to the second lateral edge, the cupped form having a lengthwise curve and a widthwise curve when not in an as-worn position, wherein the first bottom surface of the first portion is affixed to the second top surface of the second portion proximate the superior affixing location, and the second bottom surface of the second portion is affixed to the first top surface of the first portion proximate the inferior affixing location;

a first strap extending from the first end of the cupped shoulder receiving section, wherein a length of the first strap is adjustable; and a second strap extending from the second end of the cupped shoulder receiving section.

11. The cupped shoulder strap of claim 10 further comprising a first ring adapted to couple the first strap to the cupped shoulder receiving section.

12. The cupped shoulder strap of claim 10 further comprising a second ring adapted to couple the second strap to the cupped shoulder receiving section.

13. The cupped shoulder strap of claim 10, wherein the first portion is constructed from both a polymer-based material and an energy-absorbing material.

14. The cupped shoulder strap of claim 13, wherein the polymer-based material is nylon or polyester and the energy-absorbing material is a foam material.

15. The cupped shoulder strap of claim 10, wherein the first portion diverges laterally from the second portion as the first portion extends from the superior affixing point toward a midpoint, wherein the midpoint is located between the superior affixing location and the inferior affixing location along the cupped shoulder receiving section.

16. The cupped shoulder strap of claim 10, wherein at least one of a length of the first strap is adjustable or a length of the second strap is adjustable.

17. A cupped shoulder strap comprising:

a first portion of a cupped region having a convex shape with a lengthwise curve and a widthwise curve when not in an as-worn position, wherein the first portion is a flexible material having a first top surface, an opposite first bottom surface, a first lateral edge having a first lateral length, an opposite first medial edge having a first medial length, a first distal end, and an opposite first proximal end;

a second portion of the cupped region having the convex shape with the lengthwise curve and the widthwise curve when not in an as-worn position, wherein the second portion is a flexible material having a second top surface, an opposite second bottom surface, a second lateral edge having a second lateral length, an opposite second medial edge having a second medial length, a second distal end, and an opposite second proximal end;

a proximal affixing location, wherein the first portion and the second portion are affixed, at the proximal affixing location, to one another proximate the first proximal end and the second proximal end, wherein the first bottom surface of the first portion is affixed to the second top surface of the second portion, and wherein the first medial edge and the second medial edge are skewed in orientation resulting in a nonparallel relationship between the first medial edge and the second medial edge as each of the first portion and the second portion extend from the proximal affixing location;

a distal affixing location, wherein the first portion and the second portion are affixed, at the distal affixing location, to one another proximate the first distal end and the second distal end, wherein the second bottom surface of the second portion is affixed to the first top surface of the first portion, and wherein the first medial edge and the second medial edge are skewed in orientation resulting in a nonparallel relationship between the first medial edge and the second medial edge as each of the first portion and the second portion extend from the distal affixing location toward the proximal affixing location;

a first strap portion extending from a first coupling location, the first coupling location is proximate the first proximal end; and a second strap portion extending from a second coupling location, the second coupling location is proximate the first distal end.

18. The cupped shoulder strap of claim 17 further comprising:

a first coupling ring adapted for adjustably coupling the first strap with the cupped region proximate the first coupling location;

a first bag coupler adapted for coupling the first strap to a bag;

the first strap is adjustable in a length extending between the first coupling ring and the first bag coupler;

a second coupling ring adapted for adjustably coupling the second strap with the cupped region proximate the second coupling location;

a second bag coupler adapted for coupling the second strap to the bag; and the second strap is adjustable in a length extending between the second coupling ring and the second bag coupler.

* * * * *